US009724947B2

(12) United States Patent
Yada et al.

(10) Patent No.: US 9,724,947 B2
(45) Date of Patent: Aug. 8, 2017

(54) PRINTER

(71) Applicant: FUJITSU COMPONENT LIMITED, Tokyo (JP)

(72) Inventors: Yuji Yada, Tokyo (JP); Tetsuhiro Ishikawa, Tokyo (JP); Tatsuya Oguchi, Tokyo (JP); Masahiro Tsuchiya, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/258,024

(22) Filed: Sep. 7, 2016

(65) Prior Publication Data

US 2017/0072717 A1 Mar. 16, 2017

(30) Foreign Application Priority Data

Sep. 10, 2015 (JP) ..... 2015-178886

(51) Int. Cl.
*B41J 15/04* (2006.01)
*B41J 29/02* (2006.01)

(52) U.S. Cl.
CPC ..... *B41J 29/02* (2013.01); *B41J 15/042* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,507,003 | A * | 3/1985 | Wincent | B41J 15/04 400/584 |
| 5,030,968 | A * | 7/1991 | Benson | B41J 25/316 346/145 |
| 6,744,457 | B2 | 6/2004 | Seino et al. | |
| 7,806,361 | B2 | 10/2010 | Sato et al. | |
| 8,585,304 | B2 | 11/2013 | Yokoyama | |
| 9,073,718 | B2 * | 7/2015 | Chen | B65H 20/00 |

FOREIGN PATENT DOCUMENTS

| | | |
|---|---|---|
| JP | H02-160558 | 6/1990 |
| JP | 2003-246104 | 9/2003 |
| JP | 2008-143004 | 6/2008 |
| JP | 2009-028910 | 2/2009 |

* cited by examiner

*Primary Examiner* — Huan Tran
(74) *Attorney, Agent, or Firm* — IPUSA, PLLC

(57) ABSTRACT

A printer includes a body, a lid, and a restriction member. The body includes a holder configured to accommodate a roll of a recording sheet. The lid is attached to the body to be opened and closed relative to the body. The restriction member is pivotably attached to the bottom of the holder, and includes a contact part urged toward the interior of the holder. The contact part is urged to contact the peripheral surface of the roll accommodated in the holder.

11 Claims, 18 Drawing Sheets

PRINTER

CROSS-REFERENCE TO RELATED APPLICATION

The present application is based upon and claims the benefit of priority of Japanese Patent Application No. 2015-178886, filed on Sep. 10, 2015, the entire contents of which are incorporated herein by reference.

BACKGROUND OF THE INVENTION

1. Field of the Invention

The present invention relates to printers.

2. Description of the Related Art

Printers that output receipts are widely used for shop registers and automated teller machines (ATMs) or cash dispensers (CDs) in banks. Such printers perform printing on recording paper with a head while conveying the recording paper, and cut the recording paper with a cutter. The cutter includes a fixed blade and a movable blade that slides toward the fixed blade to cut the recording paper.

Such printers may include a printer body and a lid pivotably supported on the printer body. The lid is opened to allow a roll of recording paper to be loaded into a paper holder of the printer body.

Reference may be made to, for example, Japanese Patent No. 2585769 and Japanese Laid-Open Patent Applications No. 2003-246104, No. 2009-28910, and No. 2008-143004 for related art.

SUMMARY OF THE INVENTION

According to an aspect of the present invention, a printer includes a body, a lid, and a restriction member. The body includes a holder configured to accommodate a roll of a recording sheet. The lid is attached to the body to be opened and closed relative to the body. The restriction member is pivotably attached to the bottom of the holder, and includes a contact part urged toward the interior of the holder. The contact part is urged to contact the peripheral surface of the roll accommodated in the holder.

DESCRIPTION OF THE EMBODIMENTS

Figure 1:
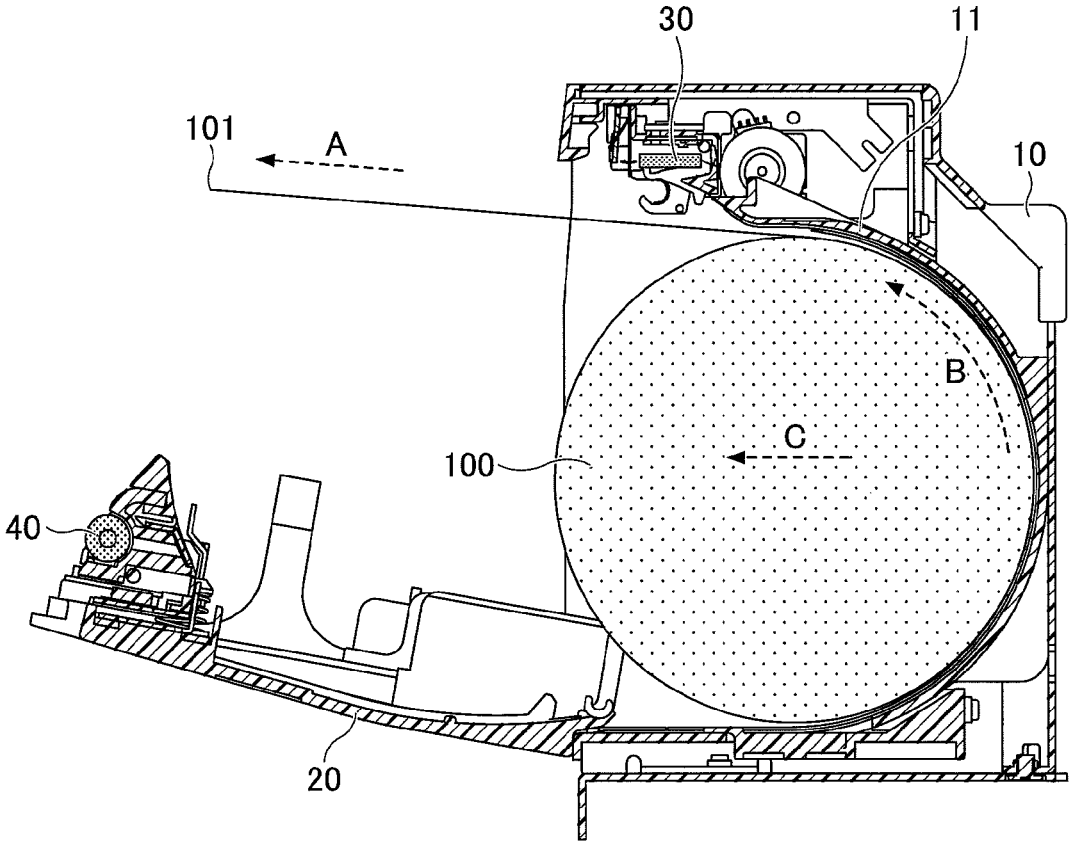
FIG. 1 is a diagram depicting a structure of a printer.

As described above, there are printers whose lid is opened to allow a roll of recording sheet (which may be hereinafter referred to as "recording paper") to be loaded into a paper holder. Such printers include drop-type printers into which a roll of recording paper is dropped and loaded without using a shaft. The drop-type printers are highly convenient because of the ease of loading recording paper.

When recording paper is loaded into the drop-type printers, the loose end of the recording paper placed in the paper holder is pulled out by a certain length or more to be held between the head and the platen roller, for example. When the loose end of the recording paper is pulled out, however, the recording paper in the paper holder may also be pulled to roll out of the paper holder. In this case, it takes time and trouble to reload the recording paper into the paper holder.

According to a printer of an embodiment of the present invention, even when the loose end of recording paper loaded into the paper holder is pulled out, the recording paper is prevented from rolling out of the paper holder.

Embodiments of the present invention are described below. The same element or member is referred to using the same reference numeral, and a repetitive description thereof is omitted.

First, the phenomenon that recording paper 100 rolls out of a paper holder 11 ("holder 11") when the loose end is pulled out after the recording paper 100 is dropped into the holder 11 in the printer is described.

Referring to FIG. 1, the printer includes a body 10 and a lid 20 pivotably attached to the body 10.

The body 10 includes the holder 11, a print head 30 ("head 30") for printing on the recording paper 100, a fixed blade, a control circuit board, and motors. The holder 11 is shaped to accommodate a roll of recording paper 100 (hereinafter referred to as "roll"). The motors include a motor for conveying the recording paper 100 and a motor for driving a movable blade. A platen roller 40 and the movable blade are provided on the lid 20.

The printer is set by placing the roll in the holder 11 and closing the lid 20.

Printing is performed on the recording paper 100 held between the head 30 and the platen roller 40.

When the recording paper 100 is placed in the holder 11, an end (leading edge) 101 of the recording paper 100 is pulled out in the direction indicated by the dashed arrow A, and the lid 20 is thereafter closed. When the end 101 of the recording paper 100 is thus pulled out, the roll rotates in the counterclockwise direction indicated by the dashed arrow B, to move in the direction indicated by the dashed arrow C to roll out of the holder 11 onto the lid 20. When the recording paper 100 thus rolls out of the holder 11, the recording paper 100 needs to be reloaded into the holder 11. Thus, it takes time to reset the recording paper 100 as described above.

First Embodiment

Figure 2:
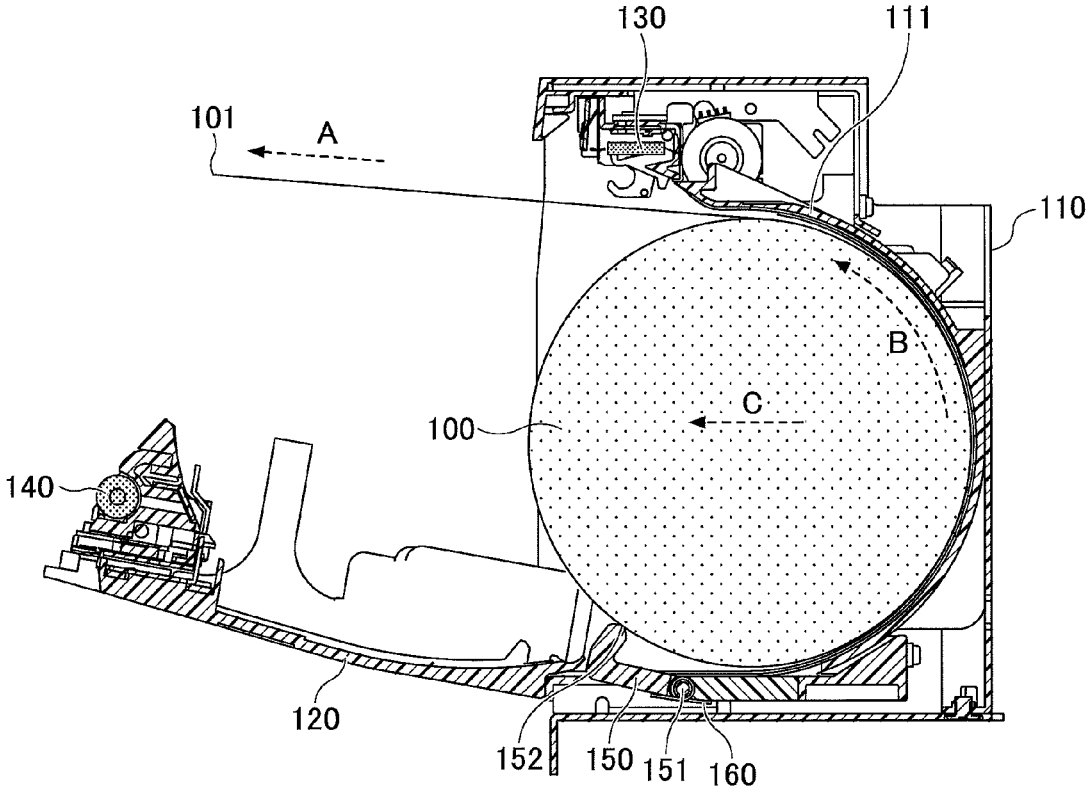
FIG. 2 is a cross-sectional view of a printer with a lid open according to a first embodiment.
Figure 3:
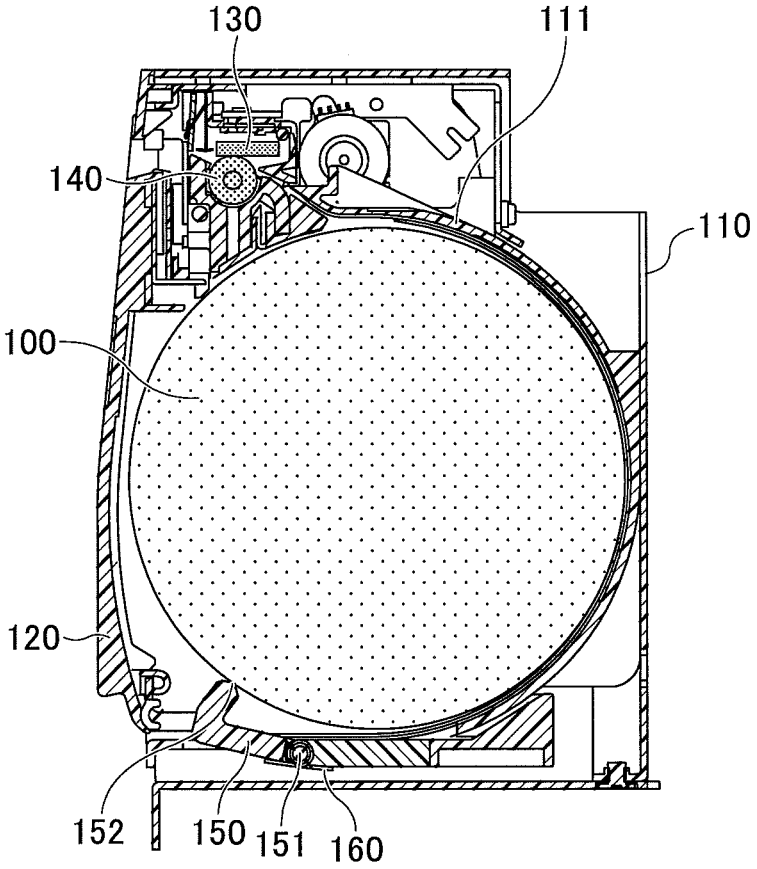
FIG. 3 is a cross-sectional view of the printer with the lid closed according to the first embodiment.

Next, a printer according to a first embodiment is described with reference to FIGS. 2 and 3. The printer of this embodiment is referred to as a clamshell printer, in which a roll of recording paper is dropped and loaded into a paper holder. FIG. 2 is a cross-sectional view of the printer with a lid open. FIG. 3 is a cross-sectional view of the printer with the lid closed.

The printer of this embodiment includes a body 110 and a lid 120 attached to the body 110 to be pivotable about a shaft.

The body 110 includes a paper holder 111 ("holder 111"), a print head 130 ("head 130") for printing on the recording paper 100, a fixed blade, a control circuit board, and motors. The head 130 is a thermal head. The inside of the holder 111 is shaped to accommodate the roll. The recording paper 100 is thermal paper. The control circuit board is provided to control the printer. The motors include a motor for conveying the recording paper 100 and a motor for driving a movable blade. A platen roller 140 and the movable blade are attached to the lid 120. Alternatively, the platen roller 140 may be provided in the body 110, and the head 130 may be attached to the lid 120.

An arm 150 is attached to the bottom of the holder 111. When the roll is loaded in the holder 111, the arm 150 is positioned between the recording paper 100 and the lid 120. A first end of the arm 150 is attached to the holder 111 to be pivotable about a shaft 151. A second end of the arm 150, which is closer to the lid 120 than the first end, projects toward a space for loading the recording paper 100 inside the holder 111 to form a contact part 152. When the roll is loaded in the holder 111, the contact part 152 contacts the peripheral surface of the recording paper 100. A spring 160 is attached to a portion of the arm 150 near its first end. The spring 160 urges the contact part 152 in a direction to contact the recording paper 100. The restoring force of the spring 160 causes the contact part 152 to press the roll upward. The contact part 152, which contacts the roll, has a smooth surface shape defined by, for example, a curved surface.

The printer is set by placing the roll in the holder 111 and closing the lid 120. The fixed blade provided in the body 110 and the movable blade provided on the lid 120 form a cutter to cut the recording paper 100. The movable blade slides toward the fixed blade to cut the recording paper 100.

The printer performs printing on the recording paper 100 held between the head 130 and the platen roller 140. That is, the platen roller 140 rotates to convey the recording paper 100, and the recording paper 100 is subjected to printing by the head 130 while being conveyed.

When the lid 120 is closed, that is, when the recording paper 100 is ready to be subjected to printing, the end 101 of the recording paper 100 is held between the head 130 and the platen roller 140. Accordingly, after the roll is loaded into the holder 111, the end 101 of the recording paper 100 is pulled out by a certain length in the direction A in FIG. 2 before the lid 120 is closed. When the end 101 of the recording paper 100 is thus pulled out in the direction A, the roll rotates in the counterclockwise direction B in FIG. 2, and a force is exerted on the roll in the direction C in FIG. 2.

At this point, according to the printer of this embodiment, the contact part 152 is in contact with the peripheral surface of the roll. Therefore, the contact part 152 restricts movement of the roll in the direction C to prevent the recording paper 100 from moving out toward the lid 120. The contact part 152 is pressed toward the recording paper 100 by the spring 160. Therefore, when a force in the direction C is applied to the roll, the roll is prevented from easily rolling out toward the lid 120.

Thus, according to the printer of this embodiment, the roll is prevented from rolling out of the holder 111 when the end 101 of the recording paper 100 is pulled out.

Figure 4:
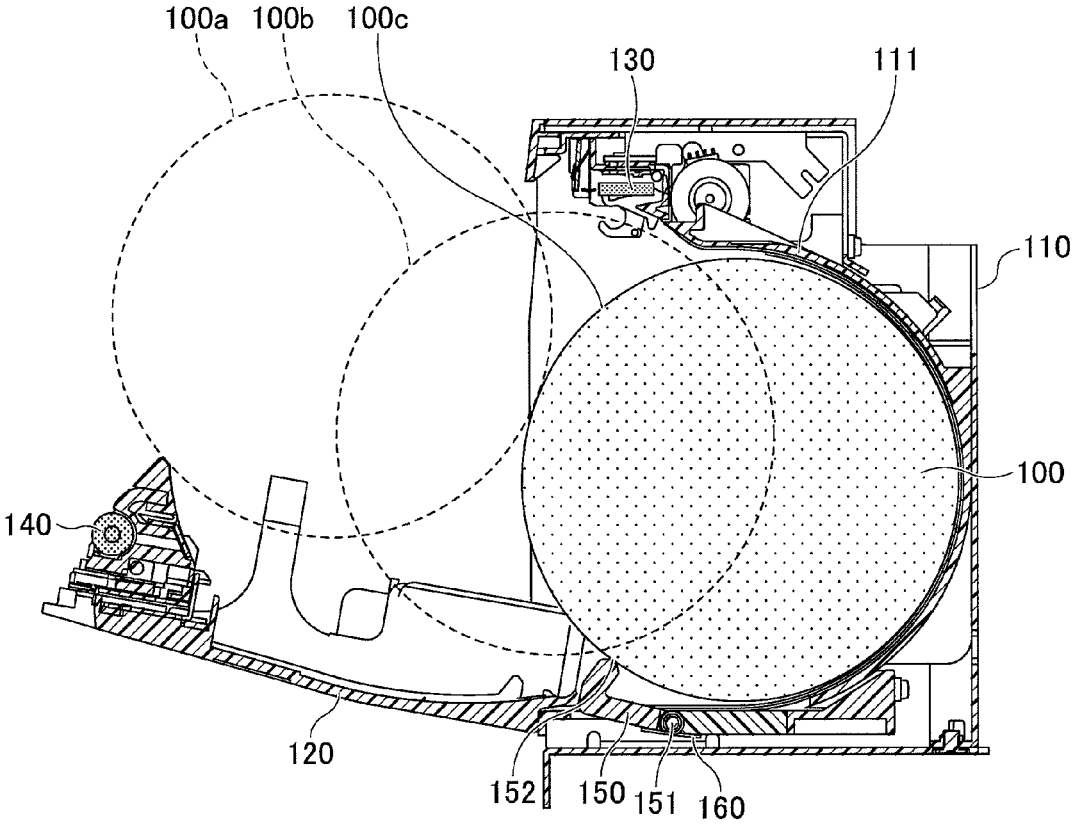
FIG. 4 is a diagram depicting a process of loading recording paper into the printer according to the first embodiment.

Next, a process of loading the roll into the holder 111 of this embodiment is described with reference to FIG. 4. When the roll is to be loaded, the lid 120 is opened, and the recording paper 100 is loaded over the lid 120 into the holder 111 through a space created by the opened lid 120. That is, when loading the recording paper 100 into the holder 111, the recording paper 100 moves from a position 100*a* indicated by a dashed line, which is near an end of the opened lid 120 at which the platen roller 140 is provided, to a position 100*b* indicated by a dashed line, which is near the connection of the body 110 and the lid 120, and further to a position 100*c* indicated by a solid line inside the holder 111.

Thus, when loading the roll into the holder 111, the roll contacts and presses the contact part 152 with the weight of the recording paper 100. As a result, the arm 150 pivots counterclockwise about the shaft 151 against the restoring force of the spring 160 to move the contact part 152 downward. Consequently, the contact part 152 is lowered to allow easy entry of the recording paper 100 into the holder 111.

Figure 5:
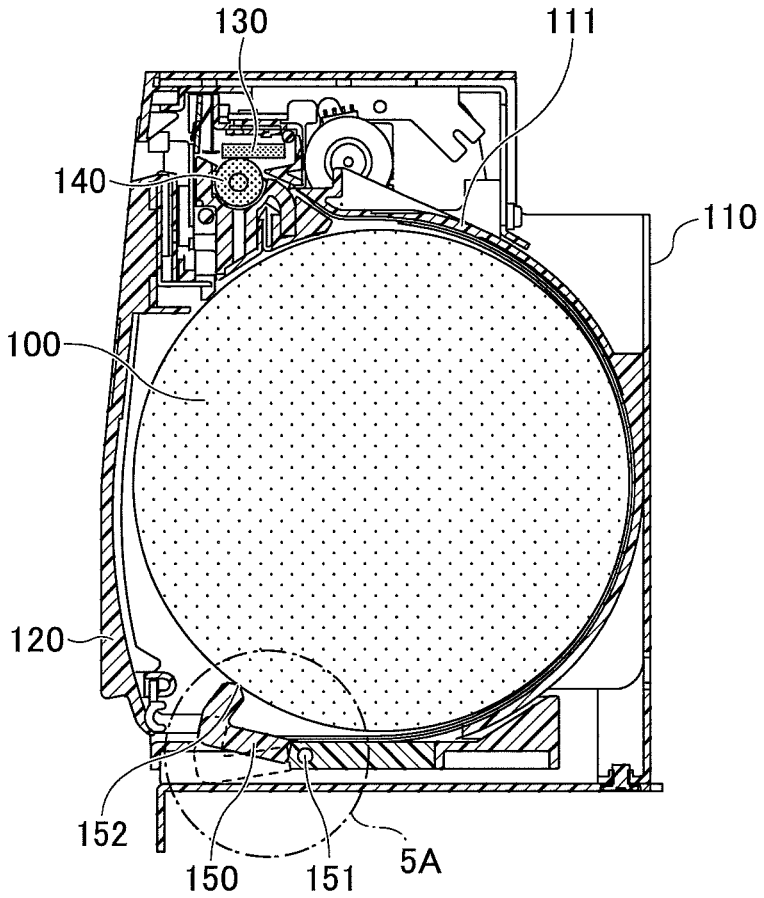
FIG. 5 is a diagram depicting the printer according to the first embodiment.
Figure 6:
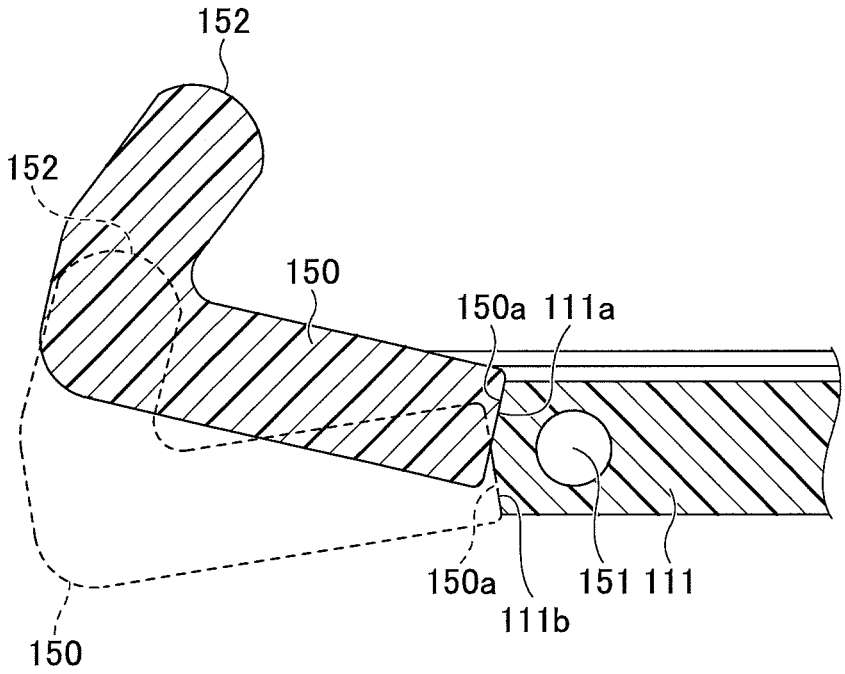
FIG. 6 is an enlarged view of part of FIG. 5.

Furthermore, referring to FIGS. 5 and 6, a stopper surface 150*a* that contacts a first surface 111*a* and a second surface 111*b* of the holder 111 may be formed at the first end of the arm 150. FIG. 5 is a cross-sectional view of the printer with the lid 120 being closed. FIG. 6 is an enlarged view of part of FIG. 5 encircled with a one-dot chain line 5A. In FIGS. 5 and 6, the spring 160 is not depicted to facilitate understanding of the drawings.

The first surface 111*a* of the holder 111 is formed to restrict the force of the contact part 152 to press the recording paper 100 with the spring 160. When the stopper surface 150*a* is in contact with the first surface 111*a* as indicated by a solid line in FIGS. 5 and 6, the restoring force of the spring 160 is prevented from further pivoting the arm 150 clockwise about the shaft 151.

Furthermore, the second surface 111*b* is formed to restrict the range of lowering of the contact part 152 when the contact part 152 is pressed by the roll loaded into the holder 111. When the stopper surface 150*a* is in contact with the second surface 111*b* as indicated by a dashed line in FIGS. 5 and 6, the arm 150 is prevented from further pivoting counterclockwise about the shaft 151 even when the contact part 152 is pressed by the recording paper 100.

Second Embodiment

Figure 7:
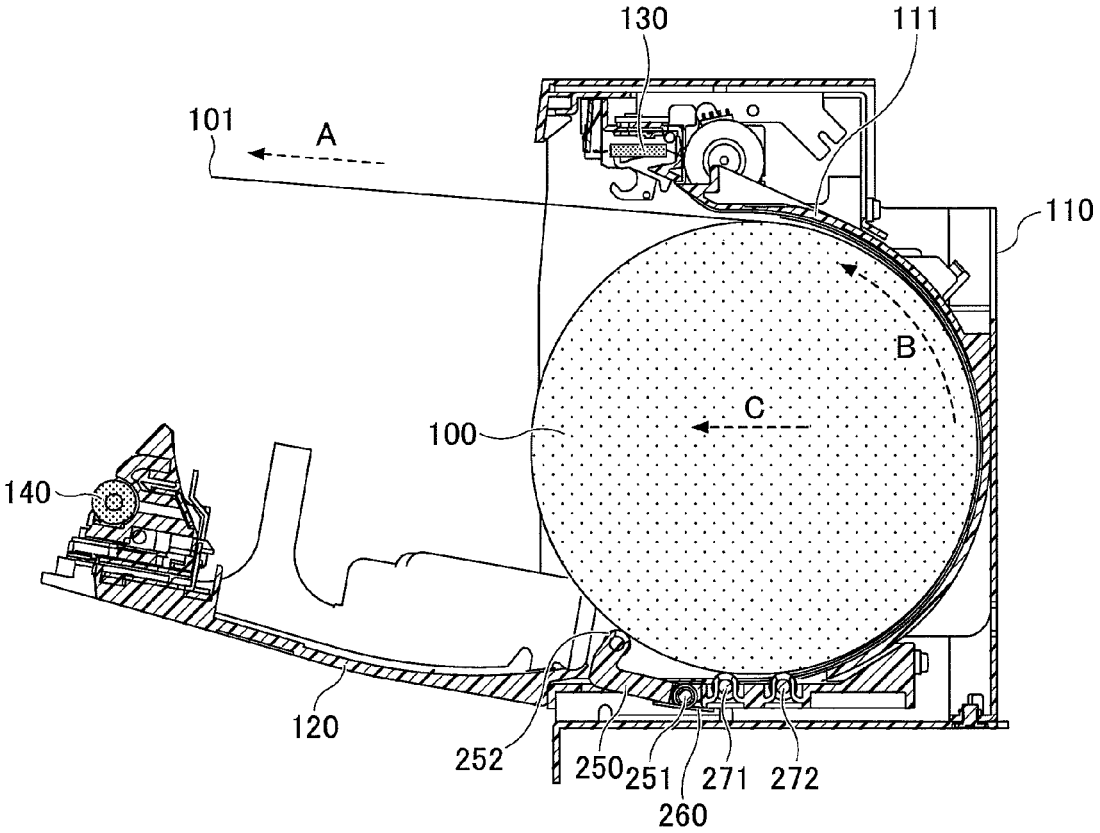
FIG. 7 is a cross-sectional view of a printer with the lid open according to a second embodiment.
Figure 8:
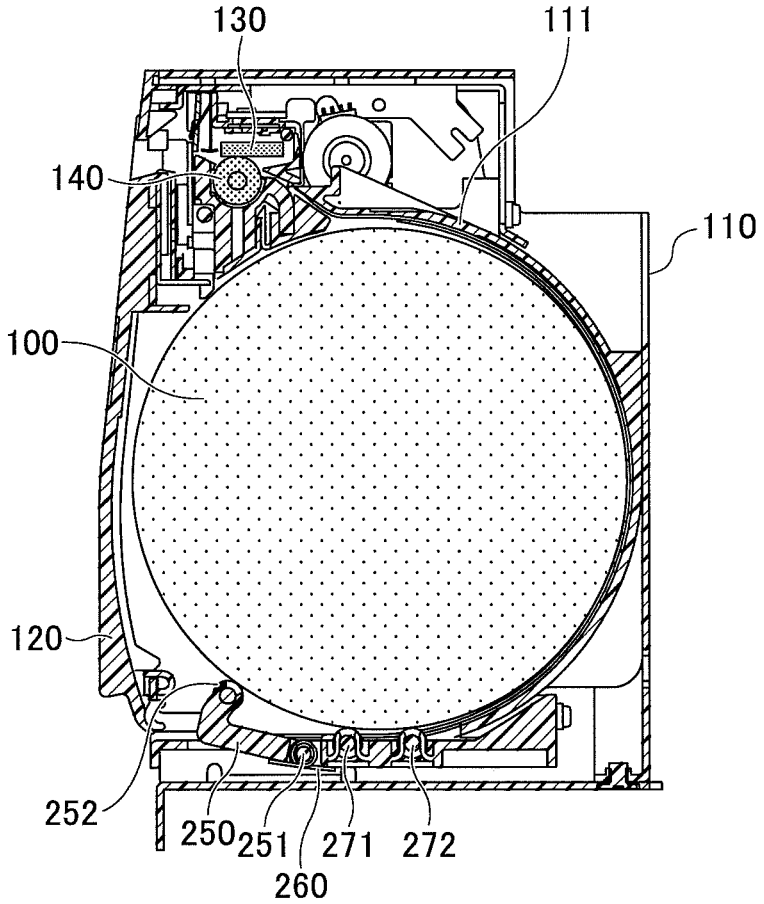
FIG. 8 is a cross-sectional view of the printer with the lid closed according to the second embodiment.
Figure 9:
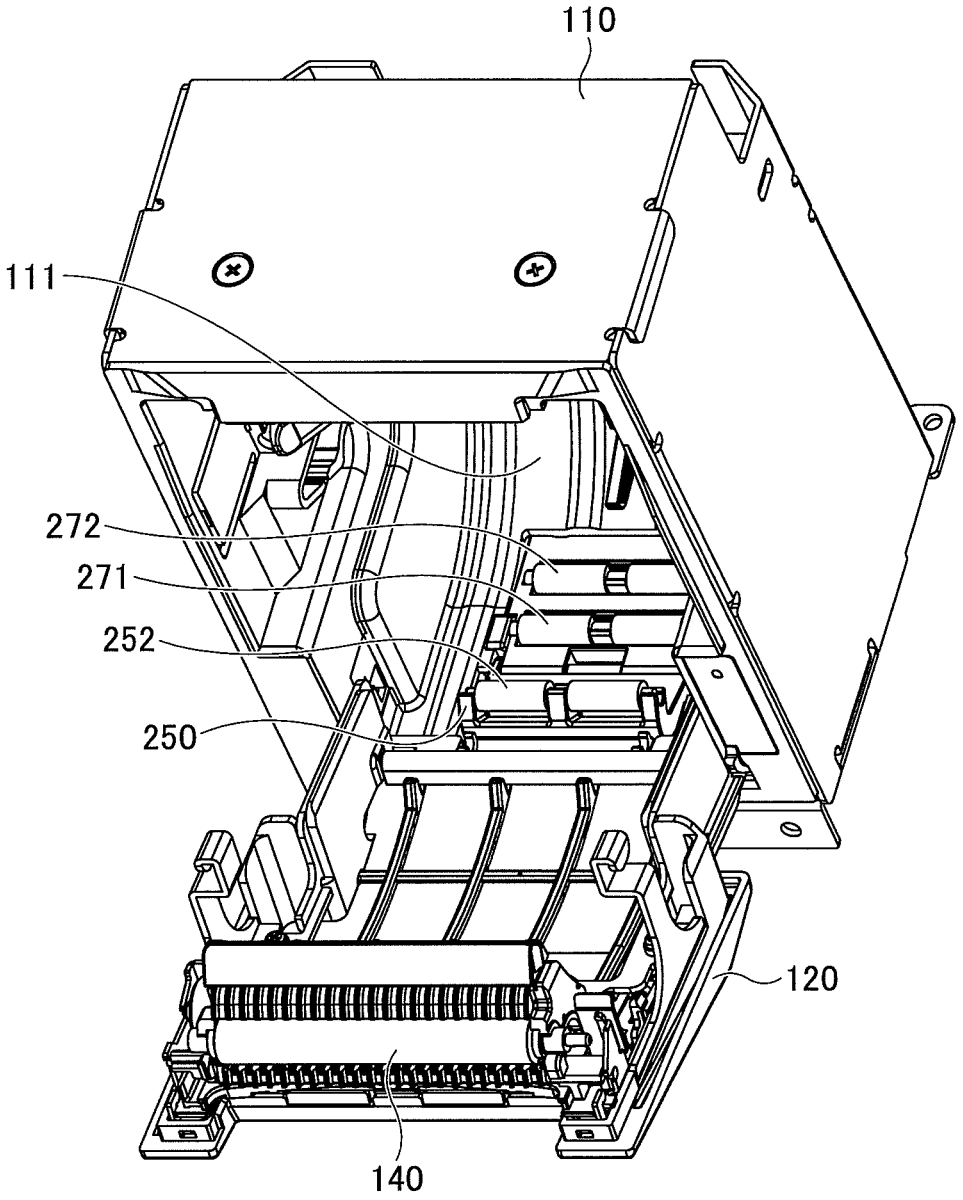
FIG. 9 is a perspective view of the printer with the lid open according to the second embodiment.

Next, a printer according to a second embodiment is described with reference to FIGS. 7 through 9. The printer of this embodiment also is a clamshell printer. FIG. 7 is a cross-sectional view of the printer with a lid open. FIG. 8 is a cross-sectional view of the printer with the lid closed. FIG. 9 is a perspective view of the printer with the lid open.

According to the printer of this embodiment, an arm 250 is attached to the bottom of the holder 111. The arm 250 is positioned between the loaded recording paper 100 and the lid 120. A first end of the arm 250 is pivotally attached to the holder 111. A contact roller 252 protruding toward the recording paper 100 inside the holder 111 is provided on a portion of the arm 250 near its second end, which is closer to the lid 120 than the first end.

When the roll is loaded in the holder 111, the contact roller 252 contacts the peripheral surface of the recording paper 100. The restoring force of a spring 260 attached to a portion of the arm 250 near its first end causes the contact roller 252 to press the roll upward. When the recording paper 100 rotates, the contact roller 252 rotatably attached to the arm 250 and contacting the recording paper 100 also rotates with the rotation of the recording paper 100.

Furthermore, a first assist roller 271 and a second assist roller 272 for assisting conveyance of the recording paper 100 are provided at the bottom of the holder 111. The roll is loaded onto the first and second assist rollers 271 and 272. The number of assist rollers provided is not limited to two, and may be determined as desired. For example, the number of assist rollers provided may be one.

When the lid 120 is closed, the end 101 of the recording paper 100 pulled out by a certain length in the direction A in FIG. 7 before the lid 120 is closed is held between the head 130 and the platen roller 140. When the recording paper 100 is thus pulled out in the direction A, the roll rotates in the direction B in FIG. 7, that is, counterclockwise, and a force is exerted on the roll in the direction C in FIG. 7.

At this point, the contact roller 252 is in contact with the peripheral surface of the roll. Therefore, the contact roller 252 restricts a movement of the roll in the direction C to prevent the recording paper 100 from moving out toward the lid 120. The contact roller 252 is pressed toward the recording paper 100 by the restoring force of the spring 260. Therefore, when a force in the direction C is applied to the roll, the roll is prevented from rolling out toward the lid 120.

Furthermore, according to the printer of this embodiment, the first and second assist rollers 271 and 272 are provided at the bottom of the holder 111. Accordingly, when the end 101 of the recording paper 100 is pulled out in the direction A to rotate the roll in the counterclockwise direction B, the first and second assist rollers 271 and 272 contacting the recording paper 100 also rotate with the rotation of the recording paper 100. Therefore, the force exerted on the recording paper 100 in the direction C is attenuated by the rotations of the first and second assist rollers 271 and 272.

Thus, according to the printer of this embodiment, the roll is prevented from rolling out of the holder 111 when the end 101 of the recording paper 100 is pulled out.

Figure 10:
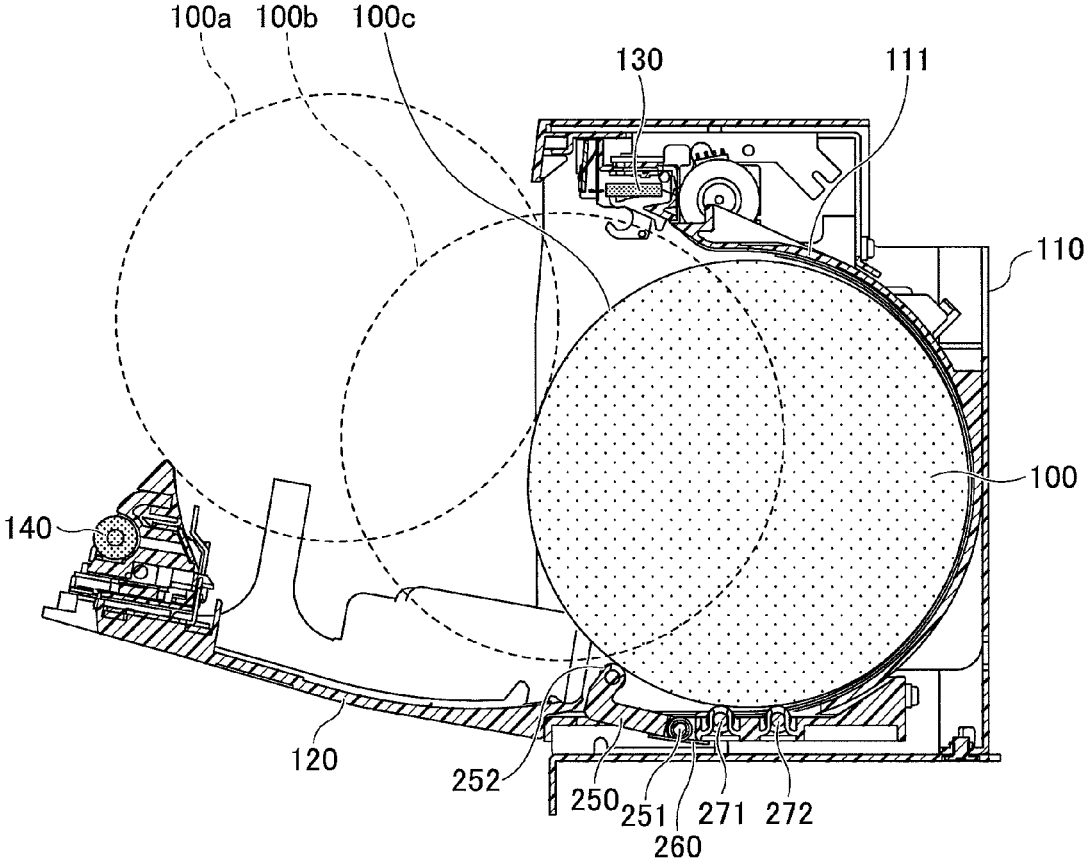
FIG. 10 is a diagram depicting a process of loading the recording paper into the printer according to the second embodiment.

Next, a process of loading the roll into the holder 111 is described with reference to FIG. 10. When the roll is to be loaded, the lid 120 is opened, and the recording paper 100 is loaded into the holder 111. When loading the recording paper 100 into the holder 111, the recording paper 100 moves from the position 100*a* which is near an end of the opened lid 120, to the position 100*b* which is near the connection of the body 110 and the lid 120, and further to the position 100*c* inside the holder 111.

Figure 11:
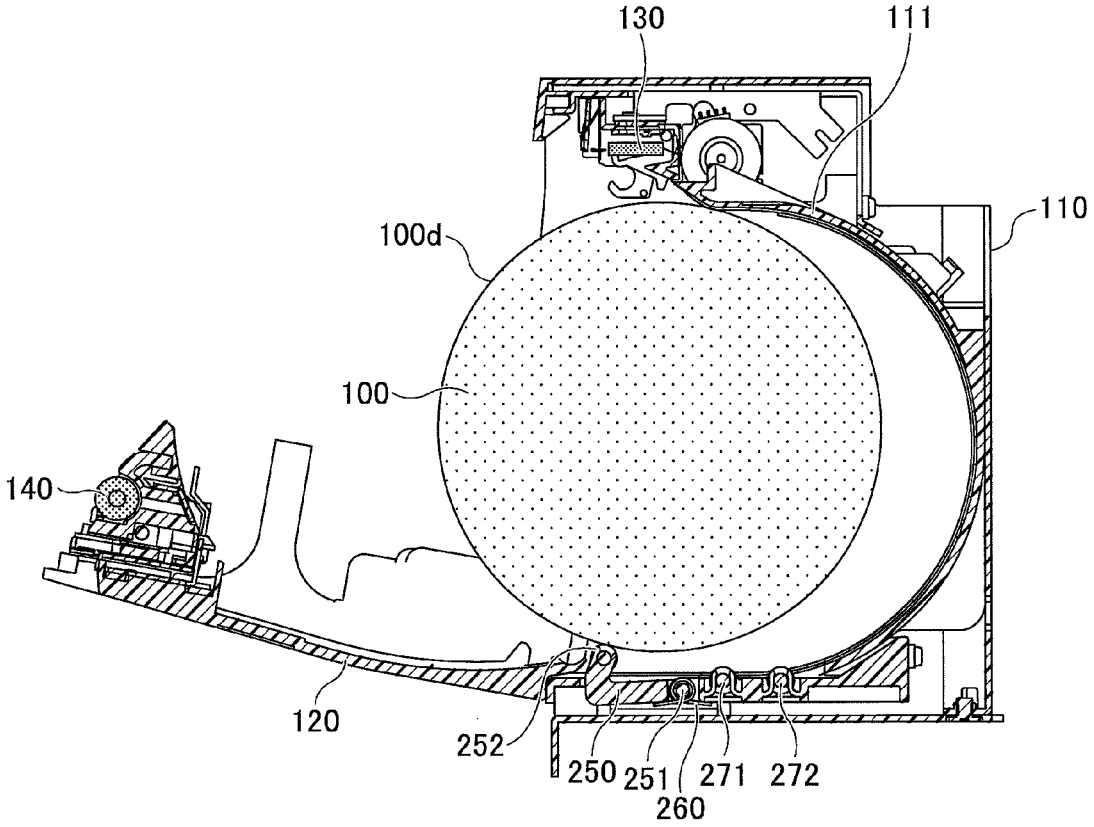
FIG. 11 is a diagram depicting the process of loading the recording paper into the printer according to the second embodiment.

Thus, when loading the roll into the holder 111, as depicted in FIG. 11, the roll contacts the contact roller 252 at a position 100*d* to press the contact roller 252 with the weight of the recording paper 100. As a result, the arm 250 pivots counterclockwise about a shaft 251 against the restoring force of the spring 260 to move the contact roller 252 downward. Consequently, the contact roller 252 is lowered, and rotates when the recording paper 100 is loaded. Accordingly, it is possible to easily place the roll into the holder 111.

Figure 12:
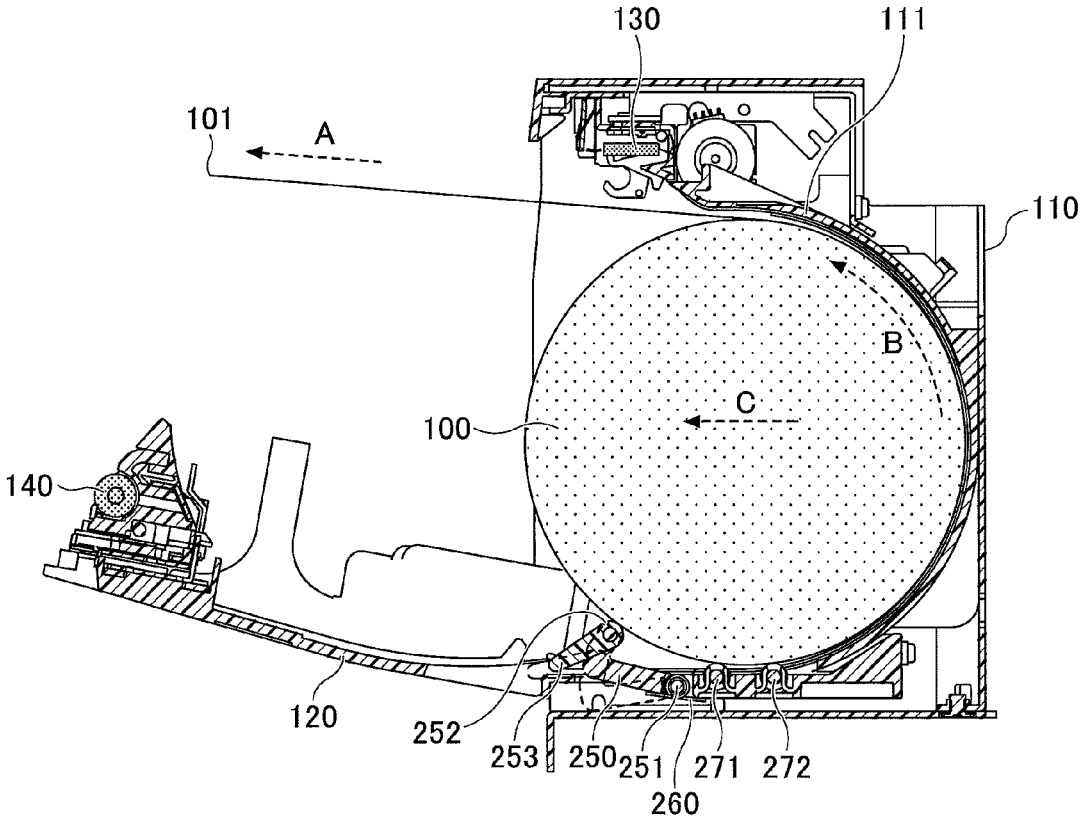
FIG. 12 is a cross-sectional view of the printer with the lid open according to the second embodiment.
Figure 13:
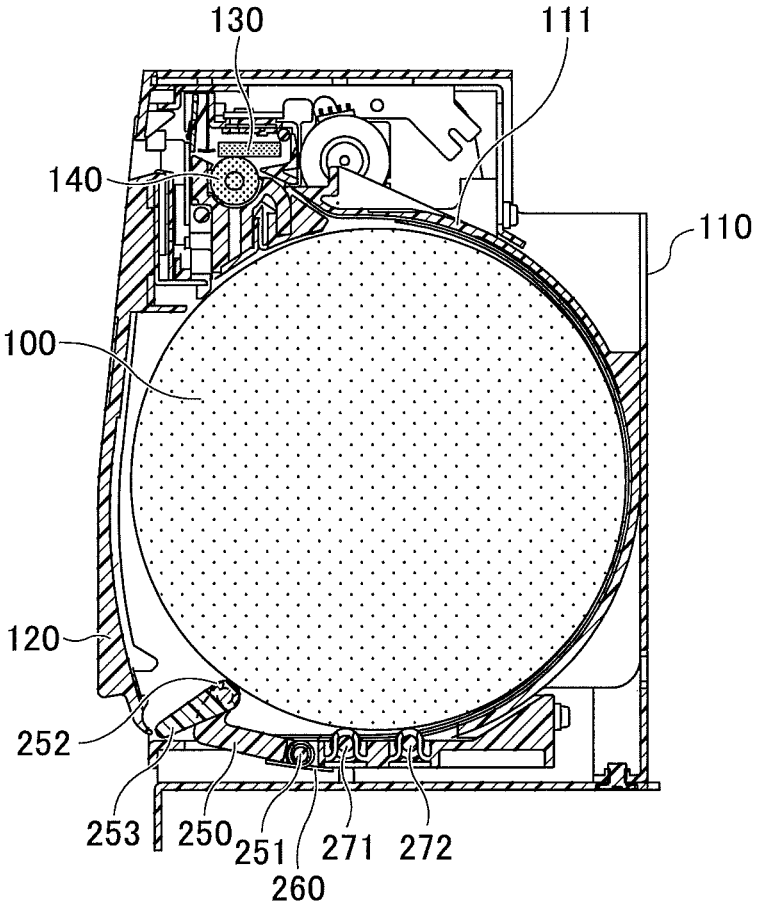
FIG. 13 is a cross-sectional view of the printer with the lid closed according to the second embodiment.

Furthermore, as depicted in FIGS. 12 and 13, the printer of this embodiment may include a slope member 253 coaxially connected to a shaft of the contact roller 252. FIG. 12 is a cross-sectional view of the printer including the slope member 253 with the lid 120 open. FIG. 13 is a cross-sectional view of the printer including the slope member 253 with the lid 120 closed. In FIG. 12, the contact roller 252 and the slope member 253 move during the loading of the roll as illustrated in the dashed outlines. The slope member 253 has a first end facing the internal space of the holder 111 and a second end closer to the lid 120 than the first end. The first end is vertically more distant from the bottom of the holder 111 than the second end. The slope member 253 gradually slopes upward from the second end to the first end. That is, the slope member 253 includes an upward slope toward the interior of the holder 111.

According to the printer as depicted in FIGS. 12 and 13, the slope member 253 forms an inclined surface between the lid 120 and the contact roller 252 to make it easy for the roll to move up onto the contact roller 252. As a result, it is possible to smoothly load the recording paper 100 into the holder 111.

In other respects than those described above, the second embodiment may be the same as the first embodiment.

Third Embodiment

Figure 14:
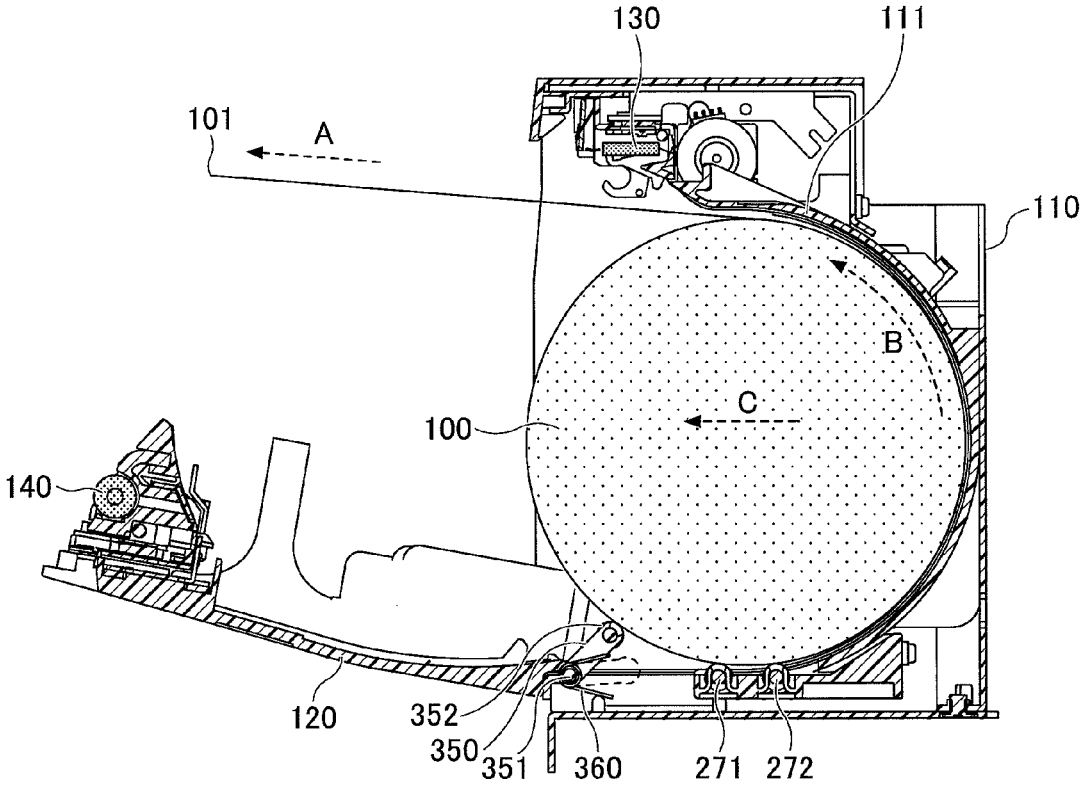
FIG. 14 is a cross-sectional view of a printer with the lid open according to a third embodiment.
Figure 15:
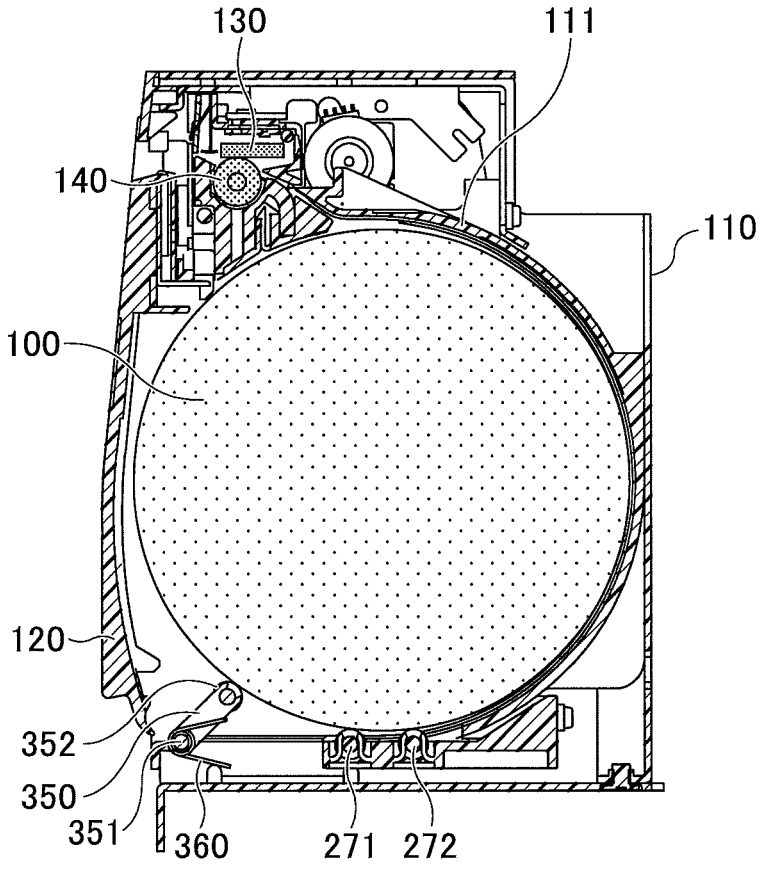
FIG. 15 is a cross-sectional view of the printer with the lid closed according to the third embodiment.

Next, a printer according to a third embodiment is described with reference to FIGS. 14 and 15. According to the printer of this embodiment, a roll of recording paper is dropped and loaded into a paper holder the same as in the second embodiment. FIG. 14 is a cross-sectional view of the printer with a lid open. FIG. 15 is a cross-sectional view of the printer with the lid closed.

According to the printer of this embodiment, an arm 350 is attached to the bottom of the holder 111. The arm 350 has a first end facing the internal space of the holder 111 and a second end closer to the lid 120 than the first end. The second end of the arm 350 is attached to the body 110 to be pivotable about a shaft 351. The shaft 351 may be a shaft about which the lid 120 is pivotable relative to the body 110. A contact roller 352 protruding toward the recording paper 100 is provided on a portion of the arm 350 near its first end. The shaft 351 is positioned between the contact roller 352 and the lid 120.

When the roll is loaded in the holder 111, the contact roller 352 contacts the peripheral surface of the recording paper 100. The restoring force of a spring 360 attached to a portion of the arm 350 near its second end causes the contact roller 352 to press the roll upward. When the recording paper 100 rotates, the contact roller 352 rotatably attached to the arm 350 and contacting the recording paper 100 also rotates with the rotation of the recording paper 100.

Furthermore, as in the second embodiment, the first and second assist rollers 271 and 272 are provided at the bottom of the holder 111. The roll is loaded onto the first and second assist rollers 271 and 272.

According to the printer of this embodiment, the contact roller 352 that contacts the peripheral surface of the roll is provided to prevent the recording paper 100 from moving out toward the lid 120. Because the contact roller 352 is pressed toward the recording paper 100 by the spring 360, the recording paper 100 is prevented from easily rolling out toward the lid 120.

Furthermore, the arm 350 gradually slopes upward from the second end to the first end to include an inclined surface to make it easy for the roll to move up onto the contact roller 352. As a result, it is possible to smoothly load the recording paper 100 into the holder 111. In FIG. 14, the arm 350 and the contact roller 352 move during the loading of the roll as illustrated in the dashed outlines.

In other respects than those described above, the third embodiment may be the same as the second embodiment.

Fourth Embodiment

Figure 16:
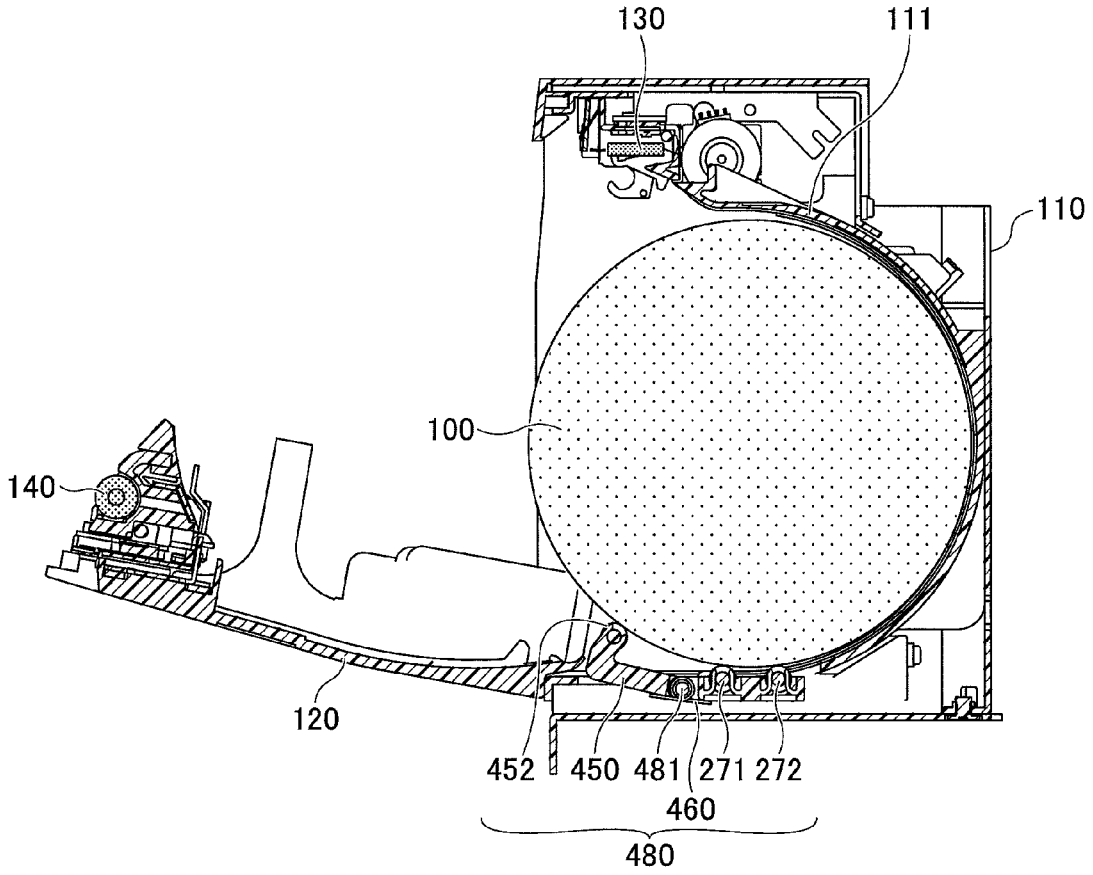
FIG. 16 is a cross-sectional view of a printer with the lid open according to a fourth embodiment.
Figure 17:
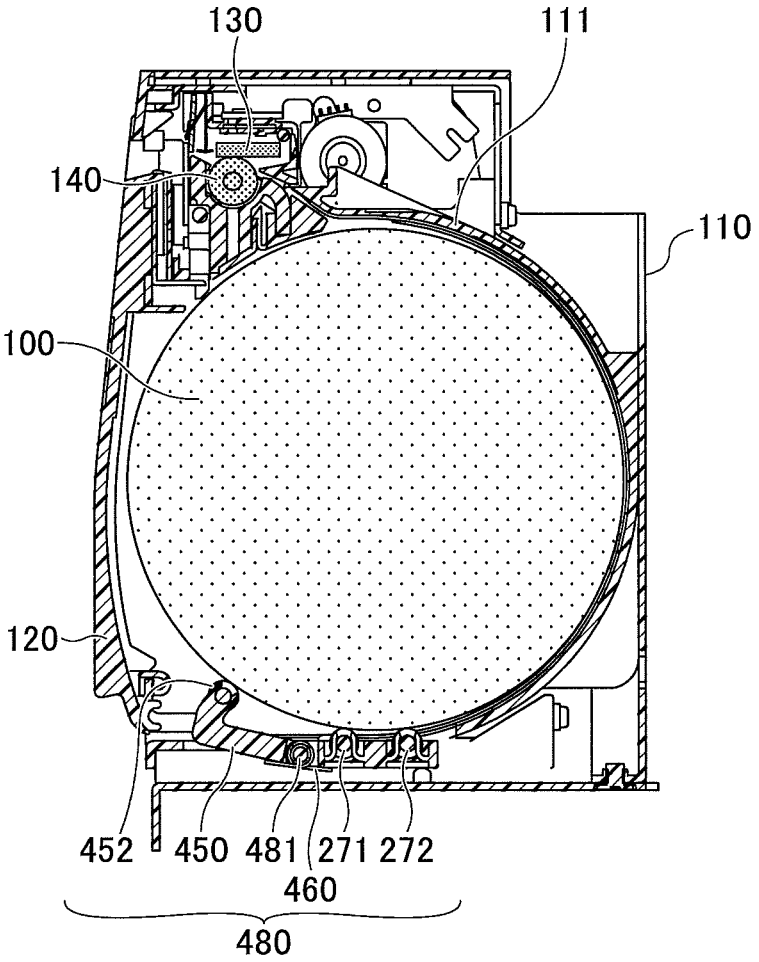
FIG. 17 is a cross-sectional view of the printer with the lid closed according to the fourth embodiment.

Next, a printer according to a fourth embodiment is described with reference to FIGS. 16 and 17. According to the printer of this embodiment, a roll of recording paper is dropped and loaded into a paper holder the same as in the second embodiment. FIG. 16 is a cross-sectional view of the printer with a lid open. FIG. 17 is a cross-sectional view of the printer with the lid closed.

The printer according to this embodiment includes a pivotable member 480 attached to the bottom of the holder 111 to be pivotable about a shaft 481. The pivotable member 480 includes an arm 450 and the first and second assist rollers 271 and 272.

The arm 450 is positioned between the shaft 481 and the lid 120. A contact roller 452 protruding toward the recording paper 100 is provided on a portion of the arm 450 near its end closer to the lid 120 than the other end. When the roll is loaded in the holder 111, the contact roller 452 contacts the peripheral surface of the recording paper 100. The restoring force of a spring 460 attached to a portion of the pivotable member 480 near the shaft 481 causes the contact roller 452 rotatably attached to the arm 450 to press the roll upward. When the recording paper 100 rotates, the contact roller 452 contacting the recording paper 100 also rotates with the rotation of the recording paper 100.

The pivotable member 480 further includes the first and second assist rollers 271 and 272, which are provided on the opposite side of the shaft 481 from the lid 120. The roll is loaded onto the first and second assist rollers 271 and 272.

Next, a process of loading the roll into the holder 111 is described with reference to FIG. 18. When the roll is to be loaded, the lid 120 is opened, and the recording paper 100 is loaded into the holder 111.

Figure 18:
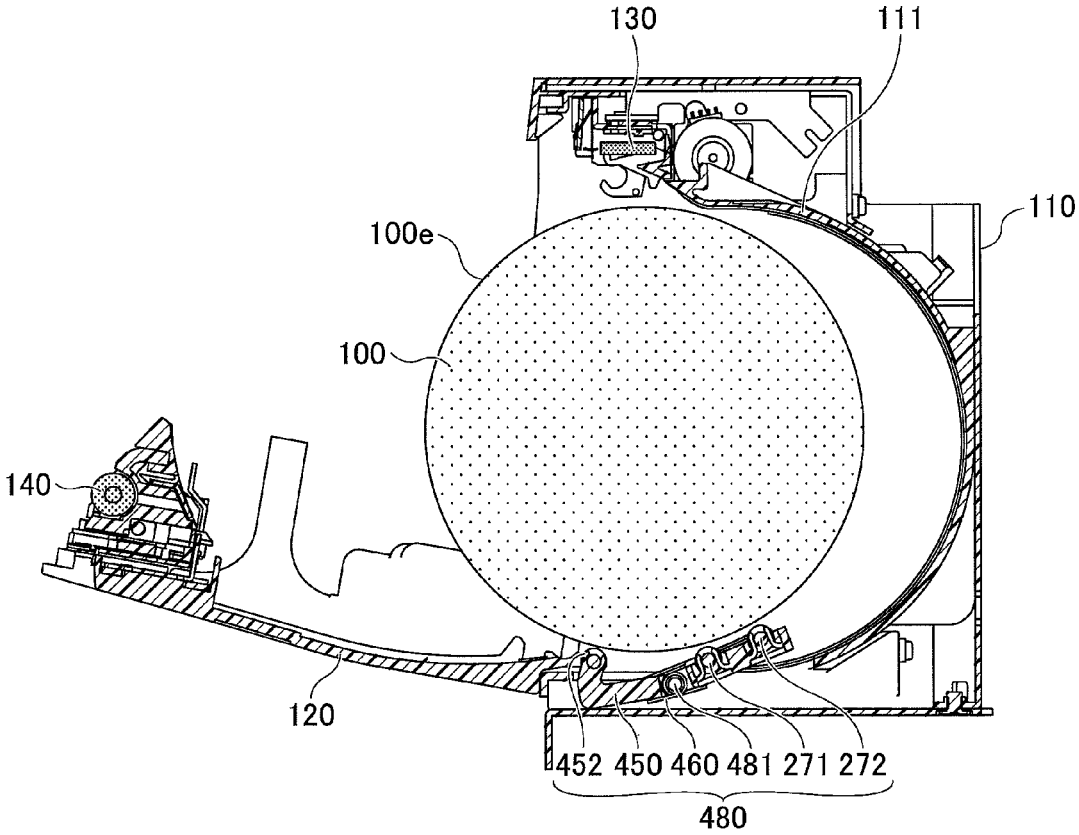
FIG. 18 is a diagram depicting a process of loading the recording paper into the printer according to the fourth embodiment.

In the process of loading the roll into the holder 111, as depicted in FIG. 18, the recording paper 100 contacts the contact roller 452 at a position 100*e* to press the contact roller 452 with the weight of the recording paper 100. As a result, the arm 450 pivots counterclockwise about the shaft 481 against the restoring force of the spring 460 to move the contact roller 452 downward and move the first and second assist rollers 271 and 272 upward. When the recording paper 100 moves further into the holder 111 from the position 100*e*, the pivotable member 480 pivots clockwise about the shaft 481 with the restoring force of the spring 460 to move the arm 450 upward and move the first and second conveyance assist rollers 271 and 272 downward, so that the recording paper 100 is accommodated in the holder 111 as depicted in FIG. 16.

According to the printer of this embodiment, when the roll is loaded into the holder 111, the pivotable member 480 including the arm 450 and the first and second assist rollers 271 and 272 pivots about the shaft 481. Accordingly, it is possible to smoothly place the roll into the holder 111.

Furthermore, the contact roller 452 contacts the peripheral surface of the roll to prevent the recording paper 100 from moving out toward the lid 120.

In other respects than those described above, the fourth embodiment may be the same as the second embodiment.

According to the above-described embodiments, the arms 150, 250 and 350 and the pivotable member 480 may be examples of a restriction member that restricts or prevent a movement of the roll toward the lid.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a body including a holder configured to accommodate a roll of a recording sheet;

a lid attached to the body to be opened and closed relative to the body; and a restriction member pivotably attached to a bottom of the holder, and including a contact part urged toward an interior of the holder, wherein the contact part is urged to contact a peripheral surface of the roll accommodated in the holder.

2. The printer as claimed in claim 1, wherein the restriction member includes an arm attached to the bottom of the holder to be pivotable about a shaft, and the arm is positioned between the roll accommodated in the holder and the lid.

3. The printer as claimed in claim 2, wherein the arm is configured to be pressed in a direction away from the interior of the holder during loading of the roll into the holder.

4. The printer as claimed in claim 2, wherein the contact part includes a contact roller rotatably attached to the arm, and configured to contact the peripheral surface of the roll accommodated in the holder.

5. The printer as claimed in claim 4, further comprising:

a slope member attached to the arm, wherein the slope member includes a first end and a second end opposite to the first end, the first end being vertically more distant from the bottom of the holder than the second end, and the slope member includes an inclined surface between the first end and the second end.

6. The printer as claimed in claim 4, wherein the arm includes a first end and a second end opposite to the first end, and is inclined so that the first end is vertically more distant from the bottom of the holder than the second end.

7. The printer as claimed in claim 4, further comprising:

an assist roller provided in the interior of the holder, and configured to contact the roll accommodated in the holder.

8. The printer as claimed in claim 1, wherein the restriction member is attached to the bottom of the holder to be pivotable about a shaft, and further includes an arm positioned on a first side of the shaft; and an assist roller positioned on a second side of the shaft opposite to the first side, wherein the contact part includes a contact roller rotatably attached to the arm, and wherein the arm is positioned between the roll accommodated in the holder and the lid, and the contact roller and the assist roller contact the peripheral surface of the roll.

9. The printer as claimed in claim 1, further comprising:

a spring attached to the restriction member to urge the contact part toward the interior of the holder.

10. A printer, comprising:

a body including a holder configured to accommodate a roll of a recording sheet;

a lid attached to the body to be opened and closed relative to the body;

a platen roller;

a print head; and an arm pivotably attached to a bottom of the holder to be positioned between the roll accommodated in the holder and the lid, the arm including a contact part urged toward an interior of the holder, wherein the contact part contacts a peripheral surface of the roll to prevent the roll from moving toward the lid.

11. A printer, comprising:

a body including a holder configured to accommodate a roll of a recording sheet;

a lid attached to the body to be opened and closed relative to the body;

a platen roller;

a print head; and a pivotable member attached to a bottom of the holder to be pivotable about a shaft, the pivotable member including an arm positioned on a first side of the shaft;

a contact roller rotatably attached to the arm; and an assist roller positioned on a second side of the shaft opposite to the first side, wherein the arm is positioned between the roll accommodated in the holder and the lid, and the contact roller and the assist roller contact a peripheral surface of the roll.

* * * * *